United States Patent [19]

Dressler, Sr.

[11] 4,054,286

[45] Oct. 18, 1977

[54] CRYSTAL BALL

[76] Inventor: Richard J. Dressler, Sr., 900 W. Warrior Drive, Round Lake, Ill. 60073

[21] Appl. No.: 711,423

[22] Filed: Aug. 3, 1976

[51] Int. Cl.[2] ..... A63H 33/26

[52] U.S. Cl. ..... 273/161; 46/227; 340/366 A; 362/118; 362/355; 362/86

[58] Field of Search ..... 273/161; 46/226, 227, 46/232; 240/2 L; 312/108, 111, 349; 340/366 A, 366 B

[56] References Cited

U.S. PATENT DOCUMENTS

| | | | |
|---|---|---|---|
| 1,345,168 | 6/1920 | Greenewalt | 240/2 L X |
| 3,743,372 | 7/1973 | Ruggerone | 312/108 |
| 3,768,314 | 10/1973 | Metzler et al. | 312/108 |
| 3,798,833 | 3/1974 | Campbell | 46/232 X |

FOREIGN PATENT DOCUMENTS

| | | | |
|---|---|---|---|
| 305,542 | 1/1930 | United Kingdom | 240/2 L |

OTHER PUBLICATIONS

Sears Fall & Winter 1969 Catalog, pp. 1358, 1359, Advertisement for "Changelite".

*Primary Examiner*—Anton O. Oechsle
*Attorney, Agent, or Firm*—Robert D. Farkas

[57] ABSTRACT

A translucent spherical lamp with dimmer switch and flasher controls, a radio receiver and microphone, and an externally grooved polygonal base.

4 Claims, 2 Drawing Figures

CRYSTAL BALL

BACKGROUND OF THE INVENTION

1. Field of the Invention

This invention relates to desk accessories and in particular, to desk lamps, radios and the like.

2. Description of the Prior Art

Crystal balls are an ancient mystical device. Lamps, radios, and other desk accessories are well known. The combination of a crystal ball and various other devices does not appear in the prior art searched which revealed only fortune telling games as disclosed by Schaper in U.S. Pat. No. 2,996,300, Wickham in U.S. Pat. No. 2,846,227 and Prola in U.S. Pat. No. 3,740,039.

SUMMARY OF THE INVENTION

It is therefore an object of this invention to overcome the limitations and disadvantages in the crystal ball devices in the prior art and currently available in the market.

One of the objects of the invention is to provide a crystal ball device embodying improved principles of design and construction.

An important object of the invention is to provide a crystal ball device which is comprised of a number of simple durable parts or components which can be economically manufactured and readily assembled.

A significant object of the invention is to provide a crystal ball desk accessory set, so designed and constructed that it can be readily installed on almost any typical desk now in use.

Another object of the invention is to provide a crystal ball which can serve as a center of amusement albeit its prime function is utilitarian.

A further object of the invention is to provide a desk accessory set that can be readily expanded in a neat, interlocking compatible form.

A lamp accessory set comprising, according to the principles of this invention, a translucent spherical object, an electric lamp and controlling dimmer switch therefor, a flasher and switch, a radio and microphone, an externally grooved polygonal base.

Further objects and advantages of this invention will appear more clearly from the following description of a nonlimiting illustrative embodiment and the accompanying drawings in which like numerals designate like parts throughout the several views.

DESCRIPTION OF THE DRAWINGS

Briefly summarized, a preferred embodiment of the invention is described in conjunction with an illustrative disclosure thereof in the accompanying drawings, in which.

DESCRIPTION OF TYPICAL EMBODIMENT

Figure 1:
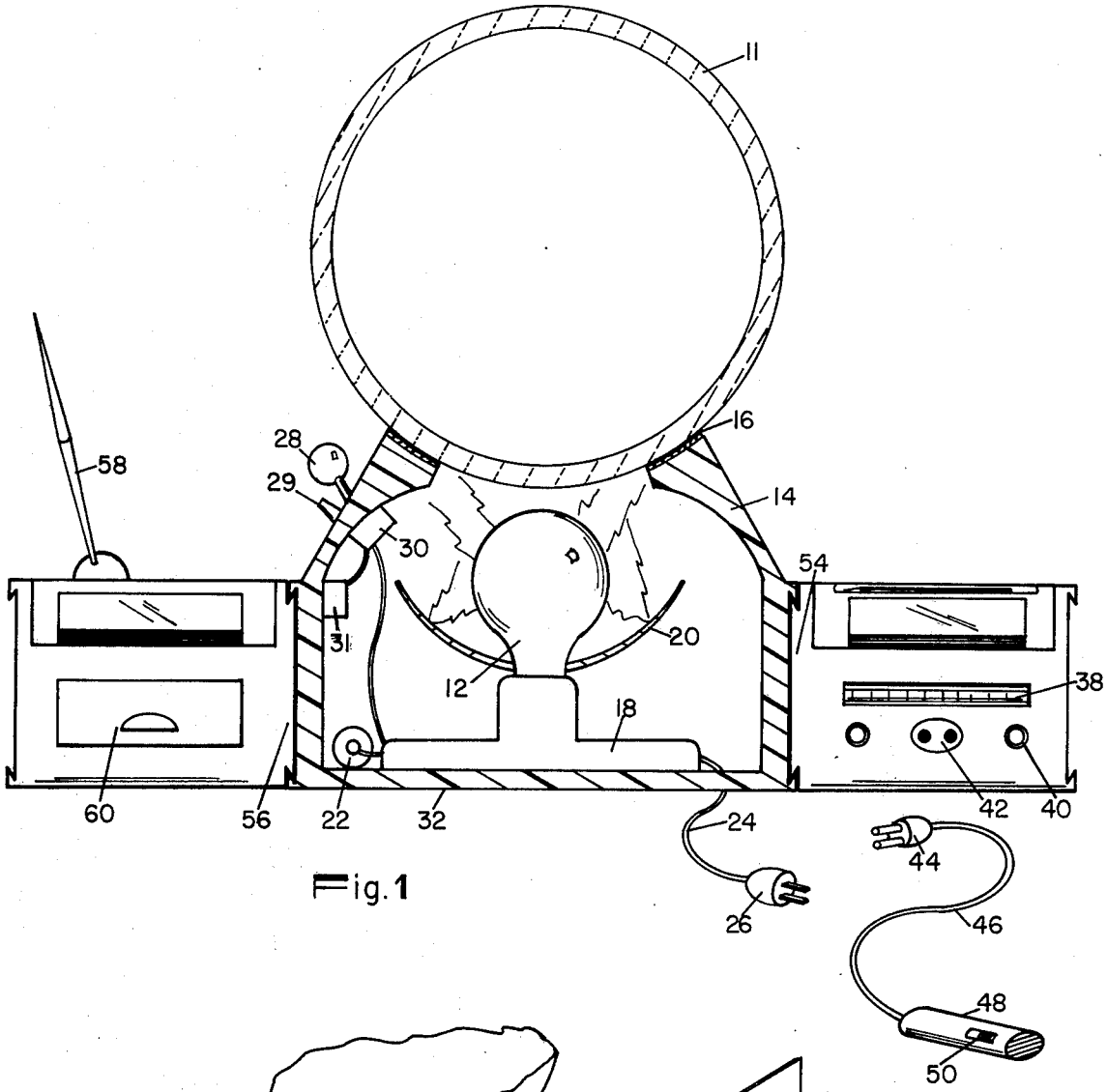
FIG. 1 is a cross-sectional elevation representation of the lamp and accessory set according to the principles of this invention.
Figure 2:
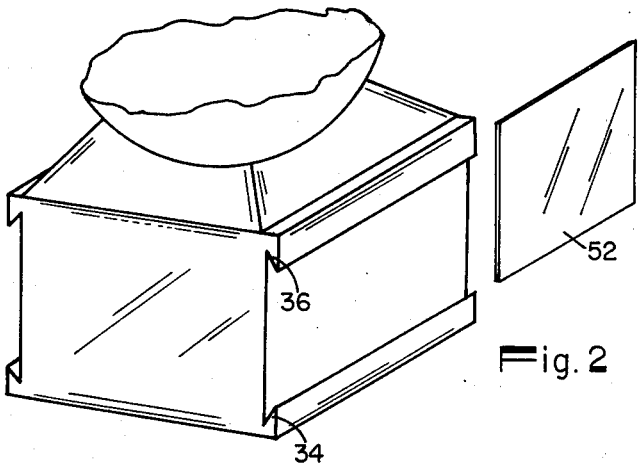
FIG. 2 is a pictorial representation of the lamp and accessory set.

In the drawings a crystal ball 11 mounted upon a base 14 embodying features of the invention is illustrated enclosing at least one electric lamp bulb 12 mounted in a known electrical base 18 and which may provide a reflector 20 to increase the useful light output from the lamp. Controls for the lamp including an on-off 28 or dimmer 30 switch and a flasher control 29, 31 may be mounted to the base as well as one or more electric storage battery 22 as a power source. Alternatively , an electrical cord set 24 with connector 26 may be provided to connect to an external energy source.

Base 14 and its bottom portion 32 may be made of any common material although plastic or wood seem most advisable. Ball resting and contact surfaces 16 may be coated with a soft cushion material to protect the ball, or with adhesive to retain the ball. Base 14 may be provided with external grooves 34, 36 and the like to permit ready secure connection of further units such as cabinet 54 containing radio 38 having manual controls 40 and an external jack 42 for connecting a microphone 48 via its cord set 46 and connector 44 and optionally provided with an on-off finger switch 50.

Grooves like 34, 36 may also be used to mount cards 52 carrying a message or a calendar, photograph, or the like. Additional cabinets 56 may be attached via additional interlocking grooves for expanding the desk accessory set for further uses including a drawer 60 for small items or for concealing the microphone, a writing instrument 58 and the like.

Crystal ball 11 is generally spherical although other shapes may be used, is preferably translucent, may be suitably colored, may be solid or hollow and may have an open bottom. The ball may be made of glass, ceramic, or plastic.

In use as a lamp, the light intensity may be controlled by the dimmer. The flasher may be used with the lamp as a signaling device to attract attention to a telephone or the like. The electronic amplifier 38 may be a radio or an intercom.

The dimmer, flasher, microphone, and electronic amplifier may be used with the crystal ball as a mystical device to create desired audio-visual effects.

From the foregoing, the construction and operation of the device will be readily understood and further explanation is believed superfluous.

The invention includes all novelty residing in the description and drawings. It is obvious to those skilled in the art that various minor changes can be made without departing from the concept of this invention and all such as fall within the reasonable scope of the appended claims are included.

What is claimed is:

1. A lamp and accessory set suitable as an amusement device comprising a translucent spherical object mounted on an opaque base, which also mounts at least one electrical lamp bulb and a dimmer switch for controlling the lamp, conductors to a source of electrical energy, the base being polygonal in plan view and having an opening disposed between said lamp bulb and said spherical object, at least one of the sides of the polygon provided with grooves for attaching other objects, one such object being an electronic amplifier which may be a radio receiver, and a microphone connectible thereto.

2. A set as in claim 1, wherein the source of electrical energy is at least one storage battery.

3. A set as in claim 1, further comprising a reflector for use with the electric lamp bulb to reflect radiant energy into the spherical object.

4. A set as in claim 1, further comprising a flasher and a switch control for the electric lamp.

* * * * *